United States Patent [19]

Davies

[11] 4,359,148

[45] Nov. 16, 1982

[54] COIN ACCEPTOR OR REJECTOR

[75] Inventor: Ronald C. Davies, Las Vegas, Nev.

[73] Assignee: Third Wave Electronics Company, Inc., Las Vegas, Nev.

[21] Appl. No.: 201,583

[22] Filed: Oct. 28, 1980

[51] Int. Cl.[3] ..... G07F 3/02

[52] U.S. Cl. ..... 194/100 A; 324/71 R; 324/236

[58] Field of Search ..... 194/97 R, 97 A, 97 B, 194/99, 100 R, 100 A, DIG. 1; 324/71 R, 77 D, 236

[56] References Cited

U.S. PATENT DOCUMENTS

| | | | |
|---|---|---|---|
| 2,642,974 | 6/1953 | Ogle | 194/100 R |
| 3,317,016 | 5/1967 | Turillon | 194/100 R |
| 3,453,532 | 7/1969 | Gardiner | 324/236 X |
| 3,587,809 | 6/1971 | Meloni | 194/100 A |
| 3,901,368 | 8/1975 | Klinger | 194/100 A |
| 3,956,692 | 5/1976 | Weinberg | 194/100 R X |
| 4,105,105 | 8/1978 | Braum | 194/100 A |
| 4,108,296 | 8/1978 | Hayashi | 194/100 A |
| 4,151,904 | 5/1979 | Levasseur | 194/100 A |
| 4,226,323 | 10/1980 | Dautremont | 194/100 A |
| 4,254,857 | 3/1981 | Levasseur | 194/100 A |
| 4,257,512 | 3/1981 | Hooker | 194/100 A |
| 4,275,806 | 6/1981 | Tanaka et al. | 194/100 A |

FOREIGN PATENT DOCUMENTS

| | | | |
|---|---|---|---|
| 951403 | 7/1974 | Canada . | |
| 1381278 | 1/1975 | United Kingdom | 194/100 A |

*Primary Examiner*—Allan N. Knowles

*Attorney, Agent, or Firm*—Jacobs & Jacobs

[57] ABSTRACT

The present invention relates to an apparatus for accepting or rejecting a single type of coin, which is designed and constructed only to accept genuine coins of a particular value or denomination, and to reject spurious coins or slugs which may have the same dimensions. The present invention also provides an auxiliary coin acceptor-rejector component or device which may readily be fitted into already existing coin operated devices so as to discriminate more accurately between genuine coins and spurious coins or slugs. In such apparatus a sensing coil is provided for discriminating between genuine and non-genuine coins by suitable circuitry to actuate an accept solenoid to receive a genuine coin in an accept slot and to direct all other non-genuine coins to a reject slot. To discriminate between genuine and non-genuine coins two parameters are utilized. The first parameter provides discrimination by means of the current being proportional to voltage drop and the second parameter provides discrimination by a frequency shift, - both of such discrimination being detectable when the coin passes through the sensing coil.

11 Claims, 6 Drawing Figures

COIN ACCEPTOR OR REJECTOR

The present invention relates to an apparatus for accepting or rejecting a single type of coin, which is designed and constructed only to accept genuine coins of a particular value or denomination, and to reject spurious coins or slugs which may have the same dimensions. The present invention also provides an auxiliary coin acceptor-rejector component or device which may readily be fitted into already existing coin operated devices so as to discriminate more accurately between genuine coins and spurious coins or slugs.

More particularly, the present invention provides an improvement in the coin acceptor or rejector device disclosed and claimed in my copending application filed Oct. 17, 1980, Ser. No. 198,283.

BACKGROUND OF THE INVENTION

As stated in my aforesaid pending application there are today many devices on the market which are primarily intended to discriminate between genuine coins and spurious coins or slugs. In view of the large number of coin-operated machines in use, it has become increasingly important to discriminate between genuine and non-genuine coins so as to minimize the losses which operators of coin-operated machines incur each year. These losses multiply rapidly as the ingenuity of man is devoted to defeating the machine instead of accommodating to it. Thus it has become a continuing contest between coin-machine operators and coin-machine users to arrive at a coin discriminating apparatus which keeps to a minimum the acceptance of spurious coins or slugs.

Even with the coin acceptor or rejector of the aforesaid patent application, there is the possibility that an ingenious person may try to cheat the coin acceptor or rejector therein disclosed by following a genuine coin in rapid succession with a spurious coin. If this should happen because the circuitry recognized the first coin as genuine, the spurious coin following it in rapid succession may still be accepted by the machine because the accept solenoid of said application was actuated for approximately 120 milliseconds.

While I recognize that it may be some time before a person may discover how to cheat the coin acceptor or rejector of my aforesaid application, by passing a spurious coin after a genuine coin in rapid succession, I believe the problem should be solved in advance of its occurrence in commercial operation.

SUMMARY OF THE INVENTION

The present invention provides an improvement in a single coin acceptor or rejector for use with coin-operated machines constructed in accordance with the disclosure of my copending application Ser. No. 198,283, filed Oct. 17, 1980. In such copending application the single coin acceptor or rejector has an oscillator circuit and a sensing coil, wherein the oscillator oscillates at a constant amplitude, and has sufficient gain that it will continue to oscillate at such constant amplitude when a coin is placed within the sensing coil. The presence of a coin within the sensing coil gives rise to: (a) a substantial decrease in the Q of the sensing coil; (b) energy losses caused by eddy currents being dissipated by the coin, and energy losses required to overcome the magnetic hysteresis of the coin; and (c) a rise in frequency of the oscillator because the coin acts as a shorted turn of the coil and effectively reduces its inductance. The oscillator is designed with enough extra gain to overcome these losses by drawing more current from the supply and thereby to maintain the same amplitude of oscillation. Also, a field effect transistor utilized in the circuit becomes in effect a variable resistor, the value of which is controllable by materials passing through the sensing coil, the effective resistance changes being detected by a resistor connected in series with the field effect transistor and which functions as a current to voltage converter. Two pairs of comparators, an opto isolator and a triac are relied upon to activate an accept armature of an accept solenoid to accept genuine coins,—all other non-genuine coils being rejected.

In the construction of such patent application a single parameter, i.e., current which is proportional to the voltage drop is utilized to discriminate between genuine and non-genuine coins.

In the present invention two parameters are used for more exact discrimination. The first parameter provides discrimination by means of the current being proportional to voltage drop. The second parameter provided by the present invention is frequency shift caused when a coin passes through the sensing coil. Thus the flapper for the accept chute of the apparatus of the present invention will only open and stay open in the accept position when the two parameters, i.e., current and voltage drop on the one hand and frequency shift on the other hand, coincidentally cooperate to actuate the accept solenoid for a predetermined period of time.

PRIOR ART

According to applicant's best knowledge the closest prior art to the present invention is his own Canadian Pat. No. 951,403, dated July 16, 1974. Applicant is also aware of the following United States Letters Patent which generally relate to Coin Apparatus for Vending Machines; Ogle U.S. Pat. No. 2,642,974; Meloni U.S. Pat. No. 3,587,809; Klinger U.S. Pat. No. 3,901,368; Braum U.S. Pat. No. 4,105,105; Hayashi et al. U.S. Pat. No. 4,108,296; and British patent to F.A.T.M.E. U.S. Pat. No. 1,254,269.

Applicant is also the inventor in U.S. Pat. application Ser. No. 21,305, filed Mar. 15, 1979, wherein the following references were made of record in addition to his own Canadian Pat. No. 951,403: Turillon U.S. Pat. No. 3,317,016; Gardiner U.S. Pat. No. 3,453,532; Weinberg U.S. Pat. No. 3,956,692; and Levasseur et al. U.S. Pat. No. 4,151,904; and a publication entitled "Electrical Fundamentals for Technicians", 2nd Edition, by Robert L. Schrader (pp. 405 to 413).

In applicant's opinion none of the foregoing prior patents, publication and pending application discloses a coin acceptor and rejector as disclosed and claimed in the present application in that they do not include the inventive features summarized above and as hereinafter more fully disclosed and claimed.

DETAILED DESCRIPTION OF THE INVENTION

For a better understanding of the invention reference will now be made to the accompanying drawings, wherein:

FIGS. 5 and 6 should be read together as showing the full circuit diagram.

Figure 5:
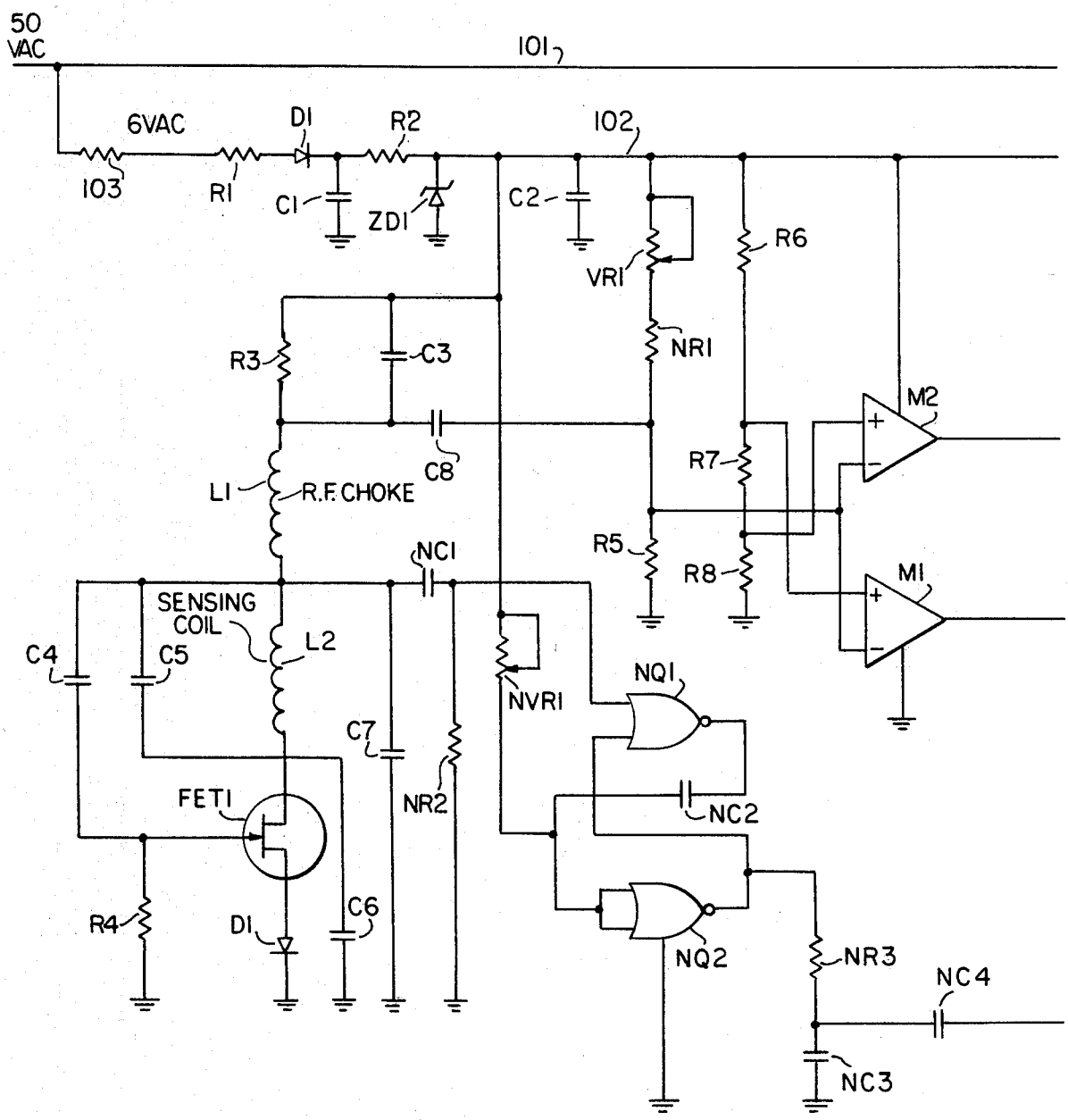
FIG. 5 shows one-half of the circuit diagram for the coin acceptor or rejector of the present invention.
Figure 6:
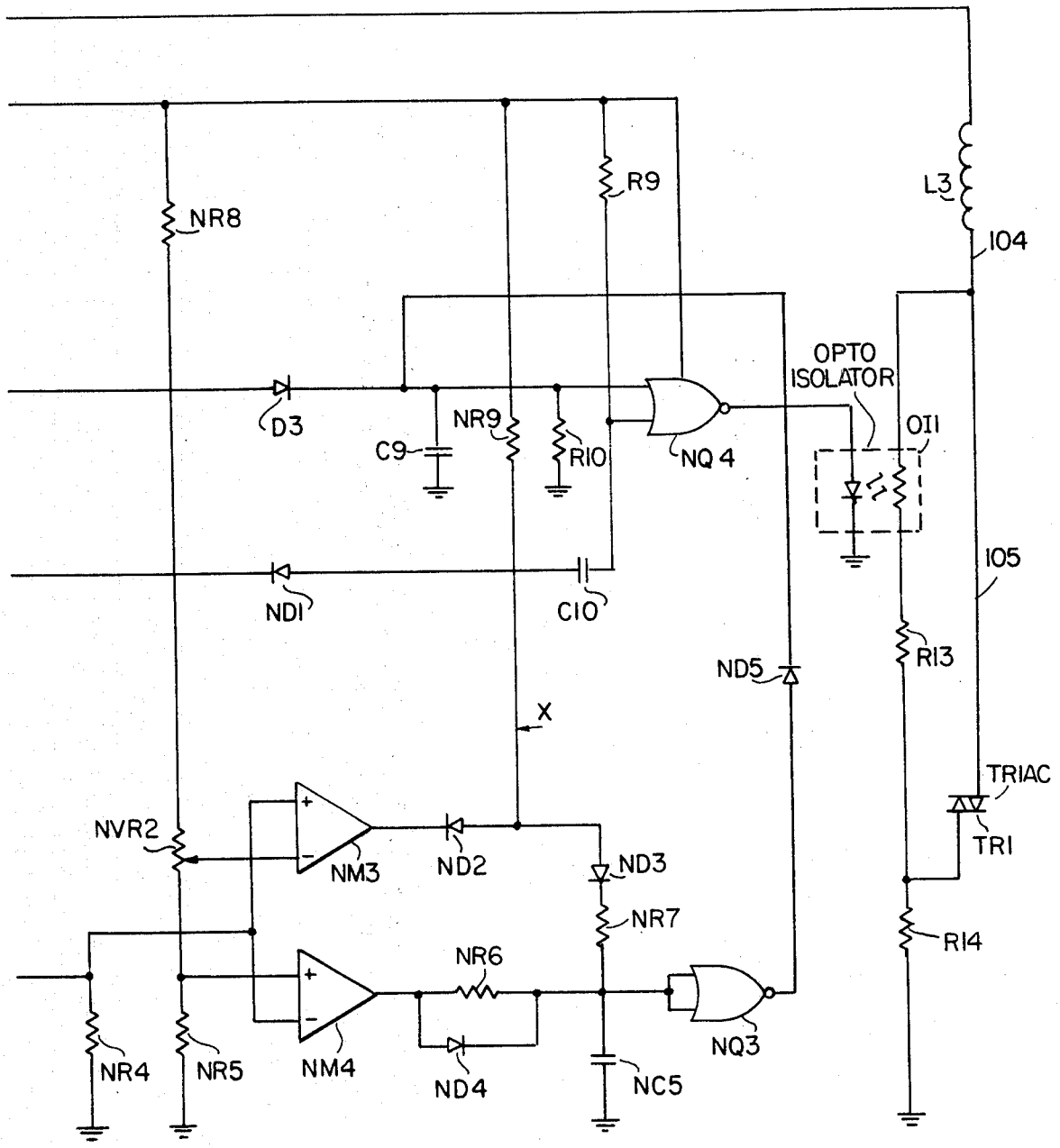
FIG. 6 shows the other half of such circuit diagram.

With reference first to FIGS. 1 to 4, inclusive, the coin acceptor or rejector therein illustrated corresponds exactly with the coin acceptor or rejector unit illustrated in FIGS. 1 to 4, inclusive, of my copending application Ser. No. 198,283, filed Oct. 17, 1980. FIGS. 5 and 6, in turn, show the original circuitry of my copending application Ser. No. 198,283, which has been modified according to the present invention to provide the dual paramenter discriminating circuit. For convenience in identifying the new components forming part of the present invention, as contrasted with the components forming part of my application Ser. No. 198,283, I have prefaced the reference numerals of each such new component with the letter "N".

Figure 1:
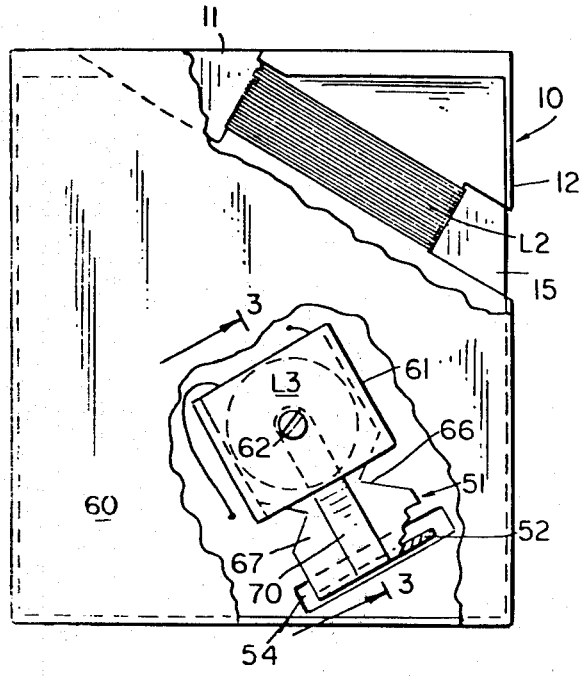
FIG. 1 is a front elevational view of the coin acceptor or rejector unit provided by the present invention which is shown in approximately full size, with certain parts being broken away to show underlying structure.
Figure 3:
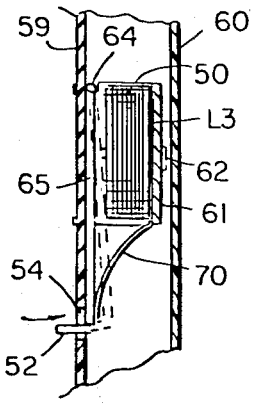
FIG. 3 is a sectional view taken along the line 3—3 of FIG. 1 and looking in the direction of the arrows.
Figure 2:
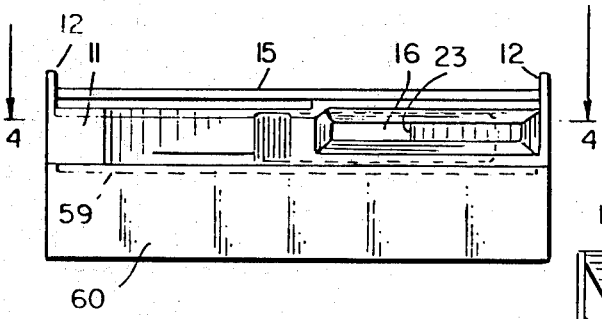
FIG. 2 is a top plan view of the unit shown in FIG. 1 and also being shown in approximately full size.
Figure 4:
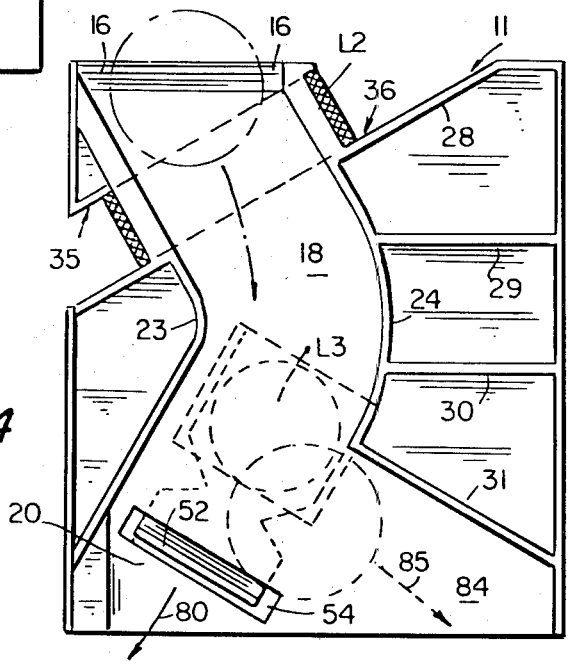
FIG. 4 is a vertical section taken along the line 4—4 of FIG. 2 looking in the direction of the arrows, and showing in full lines the coin acceptance and rejection chutes.

For completeness of disclosure there are shown in FIGS. 1 to 4, inclusive, omnibus views of the coin acceptor or rejector of the present invention. In such FIGS. 1 to 4, inclusive, a coin acceptor or rejector unit 10 has an intermediate member 11 having longitudinally-flanged sides 12 which are adapted to receive between them a back member or plate 15. The back plate 15 and the intermediate member 11, preferably made of a molded plastic material, at their upper ends together provide a coin receiving slot 16. The slot 16, in turn, connects with a coin chute 18, as best seen in FIG. 4, which is of arcuate form so as to direct the coin to an acceptance slot 20, if such coin is shown to be genuine by the unit of the present invention. The intermediate member 11, as best seen in FIG. 4, in addition to having the chute provided by upstanding molded flanges 23, 24 of arcuate form, also has upstanding reinforcing molded ribs 28, 29, 30 and 31.

Both the intermediate member 11 and the back plate 15 adjacent the coin receiving slot 16, have matching cutouts 35, 36 around which a tank coil L2 is wound so that a coin inserted in slot 16 will pass through such coil. Coil L2 is a sensing coil as more particularly hereinafter described.

At the lower end of the chute 18 there is provided an accept solenoid L3 which consists essentially of a coil 50, a metallic flapper 51 having inturned flange 52 which projects through mating slot 54 in the intermediate member 11 and the back plate 15 at the base of the chute 18 to block the same and to prevent the passage of a coin for acceptance by the machine to which the unit is applied, if such coin is determined by the unit to be non-genuine.

In addition to the intermediate molded plastic member 11 and backing plate 15 the unit also has an outer plate 59 which contains on its face all of the solid state components shown in the circuit diagram, which are suitably wired on the back of such plate in accordance with such circuitry. The entire circuit components on the front of such plate 59 are enclosed by a cover 60.

There is mounted on such plate 59 an inverted U-shaped member 61 to which accept solenoid L3 is attached at its top by a suitable screw 62. The metallic flapper 51 is hingedly connected to such plate 59 as at 64 and has a flat body member 65 generally of the size and shape to conform to the size and shape of the solenoid coil 50. It also has a narrowed neck 66 which connects with the outer flanged portion 67 of the flapper. A leaf spring 70 is secured to the inner face of the inverted U-shaped member 61 and bears against the top surface of the outer flanged portion 67 of the flapper to hold it in blocking engagement with the mating slot 54 at the lower end of chute 18. When the solenoid assembly L3 is energized according to the present invention, the electromagnetic force of such solenoid will bring the flapper 51 into contact with the lower face of said solenoid and lift the flange 52 out of the mating slot 54 whereby the coin acceptance chute will be unblocked and the coin will enter the machine to which the unit is applied in the direction shown by arrow 80. In the event the coin inserted in slot 16 should be non-genuine or a slug, flange 52 of the flapper will block acceptance of the coil and such coin will be directed to the rejection chute 84 in the direction shown by the dotted arrow 85.

For a better understanding of the circuitry of the present invention reference will now be made to the accompanying circuit diagram as shown in FIGS. 5 and 6, which should be read together, as one-half of the circuit is shown on FIG. 5 and the other half is shown on FIG. 6.

The principal components of my application Ser. No. 198,283 comprise:

(a) a sensing coil L2, also known as the tank coil, which surrounds the coin slot at its upper end;

(b) an oscillator circuit which includes a field effect transistor F.E.T.1 and capacitors C4, C6 and C7,-the F.E.T.1 switching on and off to provide the desired oscillations and together with capacitors C4, C6 and C7 providing the necessary phase shift and feedback to sustain oscillation;

(c) a resistor R3 connected in series with the field effect transistor F.E.T.1 so that the voltage drop is directly proportional to the current which flows through the field effect transistor F.E.T.1;

(d) a pair of comparator gates M1, M2 which receive changes of voltage from F.E.T.1 and R3;

(e) a second pair of comparator gates M3, M4, which in turn are connected to an opto isolator OI1 which is activated only if the output of gate M3 is high, while the output of gate M4 remains low; and (f) an accept solenoid L3 activated when the opto isolator OI1 is activated. When the accept solenoid is activated the flapper is raised by the electromagnetic effect of the solenoid to move the flapper upwardly to permit the coin to be accepted.

As before stated, for convenience in recognizing a component added to the circuitry of my application Ser. No. 198,283 to provide dual parameter discrimination, each new component is prefaced by the letter "N".

In the upper lefthand corner of FIG. 5 a source of alternating current is shown as 50 volts which has a continuous lead 101 to the accept solenoid L3. The source also has a branch 102 comprising a resistor 103 which, in turn, supplies an alternating current of 6 volts to resistor R1, diode D1 and capacitor C1, which together comprise a conventional half wave rectifier enabling the unit to be powered by 6 volts AC or DC. The resulting DC voltage appearing across capacitor C1 is connected by a limiting resistor R2 and a 6 volt zener diode ZD1 which serves to clamp the output of capacitor C1 at a constant 6 volts. Capacitor C2, which is of low value such as one microfarad, is connected between branch 102 and ground and serves to decouple any R.F. noise. A positive voltage is applied to the drain of the field effect transistor F.E.T.1 by resistor R3, RF choke L1 and sensing coil L2. Capacitors C6, C7 and C4 provide the necessary phase shift and feedback, respectively, to sustain oscillation. The source of the field effect transistor is returned to ground via diode D2 which is provided to compensate for the temperature characteristics of the field effect transistor F.E.T.1.

As before stated resistor R3 is connected in series with the field effect transistor F.E.T.1 so that there is a voltage drop across it, such voltage drop being directly proportional to the current which flows through the field effect transistor. Capacitor C3 is connected across resistor R3 to decouple any RF noise at this point.

The voltage appearing at the junction of resistor R3, capacitor C3 and RF choke L1, is coupled by a capacitor C8 to a pair of comparator gates M1 and M2. Capacitor C8 serves to isolate the quiescent voltage appearing across resistor R3 and pass only changes in voltage to the comparator gates M1 and M2.

A resistor divided network comprising resistors R6, R7 and R8 provides a fixed reference voltage to one input of the comparator gates M1 and M2, while the resistor divided network comprising variable resistance VR1 and resistor R5, provides an adjustable threshold voltage to the other input of the same comparator gates. According to the present invention resistor NR1 is added in series with variable resistor VR1 of the divider network to provide a finer adjustment of the variable resistor VR1.

It is characteristic of the comparator gates M1 and M2 that whenever the plus input of the gate is more positive than the minus input the output will be high. Conversely, whenever the minus input is more positive than the plus input then the output will be low. The reference and threshold voltages are arranged in such a manner that, under no signal conditions the output of comparator M1 will be normally high while the output of comparator M2 will be normally low.

According to the present invention which is an improvement over the circuit shown in my copending application Ser. No. 198,283, I provide two CMOS NOR gates NQ1 and NQ2 which have been connected together to form a one-shot multivibrator circuit which functions as follows: A portion of the oscillator waveform is coupled via capacitor NC1 to one input of the CMOS NOR gate NQ1; resistor NR2 provides a ground reference for this input. In its quiescent state, variable resistor NVR1 holds both inputs of CMOS NOR gate NQ2 in a high condition, thereby causing its output to be low. This output is directly connected to the second input of CMOS NOR gate NQ1 also causing its output to be low. As long as both inputs of CMOS NOR gate NQ1 remain low, its output will remain high, - which is the quiescent condition or "off" state of the multivibrator circuit.

When the oscillator voltage of field effect transistor F.E.T.1 and capacitor NC1 swings "high" the input of CMOS NOR gate NQ1, to which it is connected will follow. This will cause NQ1 to change state and its output to go "low". This "low" signal is coupled via capacitor NC2 to both inputs of CMOS NOR gate NQ2 to change its output to its "high" state and effectively confine CMOS NOR gate NQ1 in its "low" output state. This condition is the "on" period of the multivibrator and will persist for as long a time interval as it takes capacitor NC2 to charge back to the required positive level via variable resistor NVR1. In the preferred form of the invention the time constant of capacitor NC2 and variable resistor NVR1 is selected to be at least two complete cycles of the sensing oscillator waveform. During the "on" period any further positive excursions of the sensing oscillator waveform will not affect the output condition of the CMOS NOR gate NQ2, because the one-shot multivibrator circuit can only be affected by the sensing oscillator when it is in its "off" condition. Any rise in frequency of the sensing oscillator will produce a corresponding increase of constant width pulses at the output of CMOS NOR gate NQ2. It will be understood therefore that as a feature of this invention the duty cycle is a direct function of frequency shift.

Resistor NR3 and capacitor NC3 form an integrator circuit and the DC voltage developed across capacitor NC3 is directly proportional to the instantaneous duty cycle of the waveform produced by the one-shot multivibrator circuit. With a typical oscillator frequency of 600 Kcs. a U.S. quarter passing through the sensing coil L2 will raise the oscillator frequency momentarily to 604.2 Kcs. The resulting duty cycle changes of the waveform at the output of CMOS NOR gate NQ2 will produce a corresponding voltage rise across capacitor NC3 of approximately 90 millivolts.

The signal appearing across capacitor NC3 is coupled via capacitor NC4 to the appropriate inputs of a pair of comparator gates NM3 and NM4. These two gates are supplied with a voltage reference through the resistor divider network resistor NR8, variable resistor NVR2 and resistor NR5. The reference voltage at the minus input of comparator NM3 is adjustable by variable resistor NVR2 to a high enough level that only signal amplitudes produced the frequency shift produced by genuine coins will cause it to go "high". The small reference level set by resistor NR5 to the positive input of comparator NM4 is low enough to allow very small signal amplitudes to change its output state from "high" to "low". Because maximum frequency shift (the second parameter) occurs in exact coincidence with maximum loss effects (the first parameter), the output of comparator M1 will be rendered "high" at the same instant as the output of comparator NM3 is rendered "high" by the passage of a genuine coin through the sensing coil L2. These two coincidental level changes are connected to capacitor C10 through a conventional diode AND gate comprising resistor NR9, diode ND1 and diode ND2. Capacitor C10 and resistor NR9 function as the trailing edge detector described in my aforesaid pending application Ser No. 198,283 for a single parameter coin discriminating device.

Comparator NM4, CMOS NOR gate NQ3 and their associated components resistor NR6, diode ND4 and capacitor NC5 form what is best described as a second coin detector which is an important feature of the present invention.

As earlier stated, it is possible that a skillful cheater may ultimately figure out how to defeat the discriminator of the single parameter coin machine of my copending application Ser. No. 198,283 by following a genuine coin in rapid succession with a spurious coin while the accept solenoid is open for approximately 120 milliseconds. To prevent such second spurious coin from being accepted, the present invention includes in the circuitry of my said earlier application comparator NM4 and CMOS NOR gate NQ3 to discriminate against such spurious coins. The function and operation of these two components for this purpose is summarized as follows:

The reference voltage set by resistor NR5 on the positive input of comparator NM4 is low enough to allow its output to be driven "low" by the slightest amount of frequency shift signal through resistor NR4. As any spurious coin will create a frequency shift the output of comparator NM4 will be rendered "low" when any coin passes through the sensing coil L2, irrespective of whether or not it is genuine or spurious. Whenever comparator NM4 is triggered to its "low" state it begins to discharge capacitor NC5 through resistor NR6. When a genuine coin starts the discharge cycle of capacitor NC5, the output of the diode and gate circuit comprising diode ND1, diode ND2 and resistor NR9 (point X on FIG. 6 of the drawings) will be rendered "high" at the same time. In this instance therefore capacitor NC5, will be charged back up to a positive level by diode ND3 and resistor NR7 resulting in no output changes of CMOS NOR gate NQ3. Conversely, if the discharge cycle of capacitor NC5 is initiated by a spurious coin the output of the aforesaid diode and gate circuit (point X on FIG. 6 of the drawings) will remain "low" because the spurious coin would not have met the required parameters to make this point "high". In this instance capacitor NC5 will continue to discharge until it reaches a level sufficient to allow CMOS NOR gate NQ3 to change state. When this occurs, the high output of NQ3 is connected through diode ND5 to charge up capacitor C9 and thus perform the same inhibiting functions as the losses parameter at gate M2. Under these conditions the accept solenoid flapper would be instantly returned to its reject position despite any previous signal it had received to open.

The opto isolator OI1 is connected to the outputs of CMOS NOR gates NQ4 and NQ3 in such a way that the opto isolator OI1 is only activated when there is a coincidence of the two parameters, i.e., amperage and voltage drop on the one hand, and frequency shift on the other hand.

The photo cell section of opto isolator OI1 is connected to form a voltage divider with accept solenoid L3, resistor R13 and resistor R14, and is so designed as to provide sufficient gate current to trigger the triac TR1 whenever the opto isolator OI1 is activated. The main terminals of the triac TR1 are connected in series with the high voltage AC supply and the accept solenoid coil L3 through leads 101, 104 and 105, thereby activating the accept armature of accept solenoid L3 whenever the opto isolator OI1 is activated.

From the foregoing description of the apparatus and circuitry of the present invention it will be understood by reference to FIG. 4 of the drawings that a coin which is found to be genuine by the two parameter discriminators will proceed through the accept chute by raising of the flange 52 of the flapper 51. If the coin is found by the two discriminators to be non-genuine, it will be directed to the reject chute 84 in the direction of the arrow 85.

What I claim is:

1. A coin acceptor or rejector apparatus for use in coin-operated machines and the like, comprising a coin chute having a slot for receiving a coin, said chute having a coin acceptance portion and a coin rejection portion, a flapper controlling the direction of movement of coins to one or the other of said portions, an oscillator circuit adapted to oscillate at a substantially constant amplitude, a sensing coil surrounding the chute at its upper end adjacent said slot and actuated by a coin passing therethrough, said sensing coil upon receipt of a coin having its Q substantially decreased and having energy losses caused by eddy currents being dissipated by the coin and by the magnetic hysteresis of the coin whereby the effective resistance of the oscillator circuit is reduced and the current flow therethrough is increased, comparative circuitry constituting a first parameter for discriminating the change in current and resulting voltage within predetermined limits, a second parameter for discriminating by change in frequency in the oscillator circuit, and a solenoid energized by the coincidence of the predetermined limits of the first and second parameters prescribed for a genuine coin which moves the flapper to coin acceptance position.

2. A coin acceptor or rejector apparatus according to claim 1, wherein the solenoid is not energized when the first and second parameters do not coincide within predetermined limits, and the coin is directed to the rejection portion of the chute.

3. A coin acceptor or rejector apparatus for use in coin-operated machines and the like, comprising a coin chute having a slot for receiving a coin, said chute having a coin acceptance portion and a coin rejection portion, a flapper controlling the direction of movement of coins to one or the other of said portions, a sensing coil surrounding the chute at its upper end adjacent said slot and actuatable by a coin passing therethrough, a solenoid for moving the flapper to coin acceptance position, and electrical circuitry connecting said sensing coil and said solenoid and arranged to discriminate between genuine and non-genuine coins according to two parameters, the first said parameter circuit including oscillator means adapted to oscillate at a substantially constant amplitude and to provide a current proportional to voltage drop when a coin is passed through the sensing coil, and the second parameter circuit including means for effecting a frequency shift when a coin is passed through the sensing coil, the effective changes in said parameters controlling the operation of said solenoid.

4. A coin acceptor or rejector apparatus according to claim 3, wherein the oscillator of the first parameter circuit includes a field effect transistor and a resistor in series therewith.

5. A coin acceptor or rejector apparatus according to claim 3, wherein the oscillator of the first parameter circuit includes a field effect transistor, a resistor, an RF choke, and a diode in series therewith, said diode compensating for temperature characteristics of the field effect resistor.

6. A coin acceptor or rejector apparatus according to claim 3, wherein the second parameter circuit includes two CMOS NOR gates which have been connected together to form a one-shot multivibrator circuit.

7. A coin acceptor or rejector apparatus according to claim 3, wherein the second parameter circuit includes two CMOS NOR gates which have been connected together to form a one-shot multivibrator circuit and wherein a portion of the waveform of the oscillator of the first parameter is coupled to one input of one CMOS NOR gate.

8. A coin acceptor or rejector apparatus according to claim 3, wherein the second parameter circuit includes two CMOS NOR gates which have been connected together to form a one-shot multivibrator circuit and wherein a portion of the waveform of the oscillator of the first parameter is coupled to one input of one CMOS NOR gate, a variable resistor is connected to the second CMOS NOR gate holding its output in high position and causing its output to be low, the output of such second CMOS NOR gate also being directly connected to the second output of the first CMOS NOR gate and causing its output to be low.

9. A coin acceptor or rejector apparatus according to claim 8, wherein the multivibrator circuit will be in a quiescent condition when both inputs of the first CMOS NOR gate remain low and its output remains high, whereby the solenoid will not be energized.

10. A coin acceptor or rejector apparatus according to claim 3, wherein the first parameter circuit including oscillator means comprises a field effect transistor, a resistor in series therewith, and a capacitor, the second parameter circuit includes two CMOS NOR gates which have been connected together to form a one-shot multivibrator circuit with a portion of the waveform of the oscillator of the first parameter coupled to one input of one CMOS NOR gate so that when the voltage of the oscillator of the first parameter circuit is low, the input to the first CMOS NOR gate to which it is connected will be low and cause such CMOS NOR gate to change its state and its output to go high, a variable resistor conncted to both inputs of the second CMOS NOR gate holding its input in high position and causing its output to be low, the output of such second CMOS NOR gate also being directly connected to the second input of the first CMOS NOR gate and causing its input to be low, and its output to be high, the multivibrator circuit being in a quiescent or off condition when both inputs of the first CMOS NOR gate remain low and its output remains high, whereby the solenoid will not be energized.

11. A coin acceptor or rejector apparatus according to claim 3, wherein the first parameter circuit including oscillator means comprises a field effect transistor, a resistor in series therewith, and a capacitor, the second parameter circuit includes two CMOS NOR gates which have been connected together to form a one-shot multivibrator circuit with a portion of the waveform of the oscillator of the first parameter coupled to one input of one CMOS NOR gate so that when the voltage of the oscillator of the first parameter circuit swings high, the input to the first CMOS NOR gate to which it is connected will also swing high and cause the output of such CMOS NOR gate to change its state and its output to go low, such output signal in turn being coupled to both inputs of the second CMOS NOR gate causing its output signal to change to a high state and effectively to latch the first CMOS NOR gate in its low output state, whereby the multivibrator circuit is in an on condition and the accept solenoid is energized.

* * * * *